United States Patent [19]

Todo et al.

[11] 4,299,556

[45] Nov. 10, 1981

[54] TIMER CIRCUIT ARRANGEMENT IN DIGITAL COMBUSTION CONTROL SYSTEM

[75] Inventors: Kenji Todo; Motoshi Miyanaka, both of Yanai; Toshio Tanaka, Toride, all of Japan

[73] Assignee: Hitachi, Ltd., Tokyo, Japan

[21] Appl. No.: 70,722

[22] Filed: Aug. 29, 1979

[30] Foreign Application Priority Data

Sep. 6, 1978 [JP] Japan ..... 53/108642

[51] Int. Cl.[3] ..... F23N 5/00

[52] U.S. Cl. ..... 431/29; 431/14; 431/51

[58] Field of Search ..... 431/29, 30, 68, 69, 431/24; 340/515, 516

[56] References Cited

U.S. PATENT DOCUMENTS

| | | | |
|---|---|---|---|
| 3,549,088 | 12/1970 | Obenhaus | 431/68 |
| 3,644,074 | 2/1972 | Cade | 431/69 |
| 3,683,372 | 8/1972 | Horn | 431/24 |
| 4,137,035 | 1/1979 | Cade | 431/29 |
| 4,145,179 | 3/1979 | Tanaka et al. | 431/29 |

FOREIGN PATENT DOCUMENTS

| | | |
|---|---|---|
| 49-157931 | 5/1974 | Japan . |
| 51-130930 | 11/1976 | Japan . |

*Primary Examiner*—James C. Yeung

*Attorney, Agent, or Firm*—Craig and Antonelli

[57] ABSTRACT

A timer circuit arrangement for use with a digital combustion control system functions to check failure of a safety timer which stops the combustion operation in the event that ignition is not completed within a predetermined time. The arrangement has a simple circuit which checks the safety timer in advance of initiation thereof. A pre-purge timer, which determines a predetermined time for feeding only combustion air into the combustion chamber for purge thereof in advance of the combustion, and the safety timer are built with a unitary construction. A series connection of flip-flop circuits is provided for carrying out frequency division of clock pulses to obtain predetermined times, and the flip-flop circuits for the safety timer are constituted by at least a part of the flip-flop circuits for the pre-purge timer so that the pre-purge may continue infinitely when the safety timer become out of order, thereby preventing the operation for combustion and ensuring safety of operation.

22 Claims, 6 Drawing Figures

TIMER CIRCUIT ARRANGEMENT IN DIGITAL COMBUSTION CONTROL SYSTEM

This invention relates to a timer circuit arrangement in a digital combustion control system for a burner arrangement used with hot-air conditioners, hot-water boilers and the like, and particularly to an improvement of a timer circuit arrangement in a digital combustion control system for a burner arrangement which determines operation timings of components of the control system. This invention contemplates a countermeasure for failure of a safety timer which functions to stop the combustion in the event that the ignition is not completed within a predetermined period of time and to stop all the operations eventually. The countermeasure incorporates a simple circuit being capable of checking the safety timer in advance of initiation of its operation.

The invention will be explained in detail with reference to the accompanying drawings in which.

Figure 1:
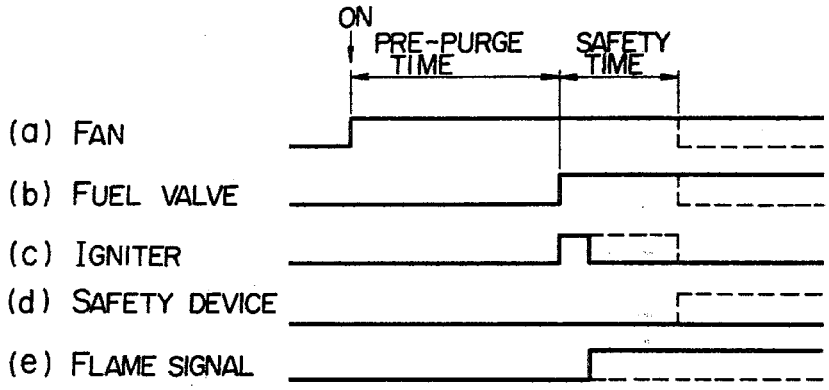
FIG. 1 is a wave-form diagram useful to explain operation of components of a combustion control system.

The function of this type of combustion control system will be described with reference to FIG. 1. When a combustion starting instruction is received from a manual operation switch, a combustion fan is first started to operate (FIG. 1(*a*)) to feed air into a combustion chamber in order to purge combustion gas remaining within the combustion chamber in advance of the start of combustion. This process is called pre-purge. At the same time, a pre-purge timer starts to count time for the pre-purge. After a predetermined preiod of time, the pre-purge timer delivers a pre-purge termination signal to start the ignition operation. Namely, the pre-purge termination signal causes a fuel valve to open (FIG. 1(*b*)) and an ignition device to actuate (FIG. 1(*c*)) thereby starting the ignition operation. Simultaneously, a safety timer starts its counting operation. Thus, it is to be noted that the pre-purge termination signal corresponds to an ignition starting signal. If ignition is completed within a preset period of time of the safety timer and a flame signal is obtained from a flame detector (FIG. 1(*e*)), the output of the safety timer is interrupted, thereby keeping the fuel valve opened to continue the normal combustion. The flame signal stops the actuation of the ignition device.

In the event of failure of ignition within the time set by the safety timer, i.e., failure to obtain the flame signal, the safety timer produces an ignition-failure signal at the end of the preset period of time. A safety device is then actuated (FIG. 1(*d*)) to disable the fuel valve, ignition device and fan, thus stopping the operation of the burner arrangement.

As will be seen from the above, the safety timer functions to prevent discharge of fuel and to stop the operation of the burner in the event of failure of ignition, thereby preventing danger and securing safety. Thus, the timer is very important in view of safety of operation.

In the event of failure of ignition, if a component of the safety timer such as a frequency division flip-flop circuit becomes out of order and the frequency division is not effected, the safety timer cannot reach the end of counting of the preset period of time and is prevented from delivery of the ignition-failure signal. Consequently, the devices continue operations including fuel injection, resulting in dangerous conditions.

One approach to this problem is the provision of two safety timers and another is the prevision of a checking circuit for the safety timer. These approaches, however, require complicated circuits and are not practical.

Typically, a simple timer circuit utilizes charge and discharge of a capacitor. One example of conventional timer circuit of this type is disclosed in Japanese Patent Application No. 54119/74 published without examination on Dec. 20, 1975 as Laid-open No. 157931/75 and entitled "Combustion Control System". In a system disclosed therein, a programmable unijunction transistor (PUT) is turned on to actuate a relay when a capacitor is charged to a given level and the charging time determines the pre-purge time. Then, as the capacitor is discharged, the transistor PUT is turned off and the discharging time determines the safety time. Therefore, if the PUT malfunctions, the system fail to determine the pre-purge time and hence the ignition operation is no longer started.

In another example of prior art as disclosed in Japanese Patent Application No. 54703/75 published without examination on Nov. 13, 1976 as Laid-open No. 130930/76 and entitled "Combustion Control System", as a capacitor is charged, a transistor is turned on to produce a first pulse which actuates a relay and the charging time determines the pre-purge time. The capacitor is immediately discharged and then undergoes a second charging thereby to turn on another transistor. The second charging time determines the safety time. Charging current to the capacitor for the first charge and that for the second charge are separately adjustable so that the pre-purge time and the safety time are independently adjustable. In this prior art system, the ignition operation is also no longer started if the system fails to produce the first pulse.

The above examples determine the pre-purge time and the safety time based on charging time or discharging time of a capacitor. The determination of the pre-purge and safety times based on the charge and discharge of the capacitor is difficult to provide accurate setting of the pre-purge time and the safety time and also disadvantageous in that it requires a capacitor of large capacitance when the setting time is relatively long.

To solve these problems, a timer circuit has been proposed which utilizes the frequency division of a reference clock pulse signal by means of a frequency division circuit. A combustion control system using such a timer circuit is disclosed, for example, in U.S. Pat. No. 4,145,179 issued Mar. 20, 1979 to Toshio Tanaka et al and entitled "Combustion Control System". In this prior art system, however, not only the aforementioned problem due to failure of the timer circuit still remains unsolved, but also two separate timer circuits are required.

Therefore, an object of the invention is to provide a simple timer circuit arrangement in which a safety timer which produces an ignition-failure signal is automatically checked in advance of initiation of the timer operation, thereby improving safety of operation.

Another object of this invention is to incorporate the safety timer and a pre-purge timer in a unitary construction.

Still another object of this invention is to apply the checking arrangement to a digital timer.

According to the present invention, a time circuit arrangement is arranged such that counting of a pre-purge time is initiated with an operation starting signal with which the pre-purge operation is started and an ignition operation is started with a pre-purge termination signal which is produced at the end of counting of the pre-purge time, and in the event that a flame signal is not produced within a predetermined period of time after the occurrence of the pre-purge termination signal, an ignition-failure signal is produced in response to a predetermined time termination signal produced at the end of the predetermined period of time thereby to stop the ignition operation, and wherein a first flip-flop device is provided for determining the end of said predetermined period of time, said first flip-flop device being composed of at least a part of a second flip-flop circuit device provided for effecting frequency division on clock pulses thereby to determine the end of counting of said pre-purge time.

The invention will now be described by way of embodiments as illustrated in the accompanying drawings.

Figure 2:
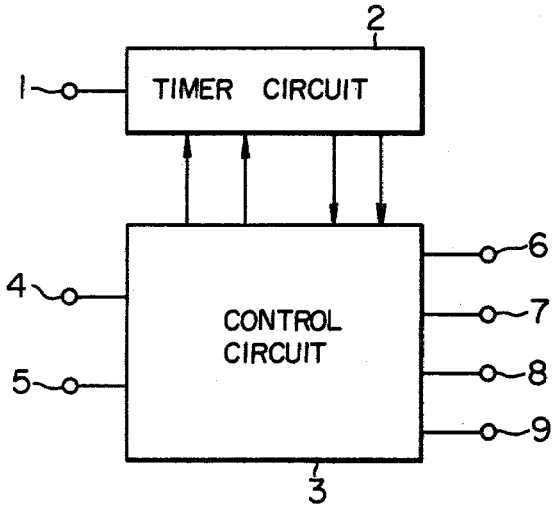
FIG. 2 is a schematic block diagram of the combustion control system.

Referring to FIG. 2, an outline of a digital combustion control system of the type hereinbefore described will first be explained. Clock pulses are applied through a terminal 1 to a timer circuit 2 where the clock pulses undergo a frequency division operation upon receiving an operation starting signal from a control circuit 3 thereby to generate a pre-purge termination signal after a predetermined period of time, and the pre-purge termination signal is sent to the control circuit 3. The control circuitry 3 also receives external input signals such as a flame signal sent from a flame detector at a terminal 4 and a temperature signal sent from a temperature detector at a terminal 5. In response to the temperature signal, the operation starting signal is produced. Sequence of the combustion control is determined by the external input signals and the pre-purge termination signal so that combustion control output signals are transmitted at the timings of those signals to a combustion fan driving signal terminal 6, ignition driving signal terminal 7, and a fuel valve driving signal terminal 8. A fan, a fuel valve, and an igniter are thereby actuated. In the event of failure of ignition, the timer circuitry 2 generates an ignition-failure signal which enables the control circuitry 3 to deliver to a safety device driving signal terminal 9 an alarm signal which in turn actuates a safety device to stop the overall operations.

Figure 3:
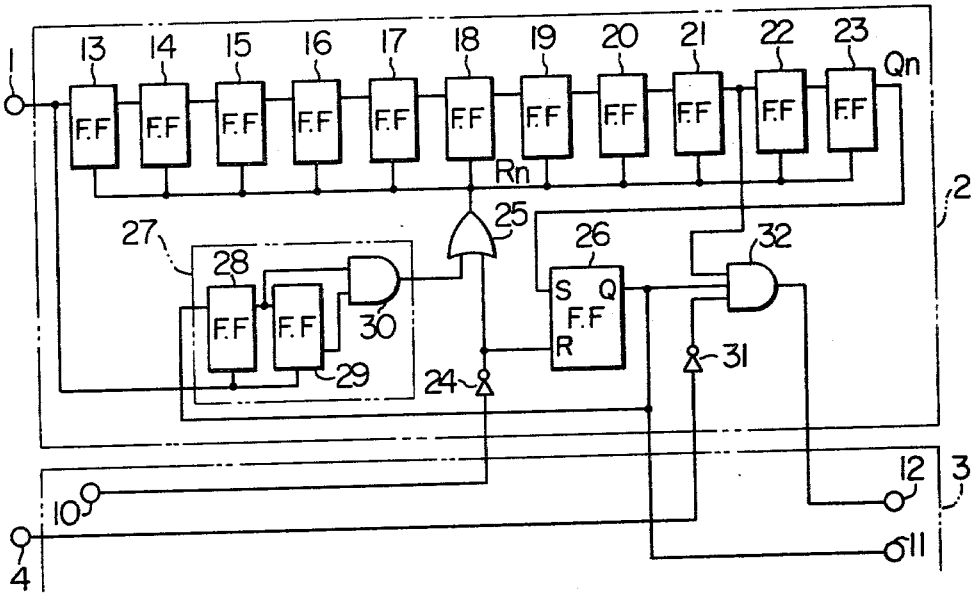
FIG. 3 is a circuit diagram of a timer circuit arrangement of a digital combustion control system embodying the invention.

Referring to FIG. 3, there is shown a circuit arrangement illustrative of one embodiment of the invention, which operates with digital signals "0" or "1". The circuit arrangement shown comprises an operation starting signal terminal 10, a pre-purge termination signal terminal 11 and an ignition-failure signal terminal 12. A series of trigger-type flip-flop (T flip-flop) circuits 13 to 23 for frequency division constitute a timer. The output terminal of each flip-flop circuit is represented by Qn (n: 13, 14, . . . or 23) and the reset input terminal of each flip-flop circuit is represented by Rn (n: 13, 14, . . . or 23). The reset input Rn being "1" resets the corresponding flip-flop circuit, rendering it to deliver the output Qn which is "0". An operation starting signal 10 is applied to the reset input terminal Rn via an inverter 24 and an OR gate 25. An R-S flip-flop circuit 26 delivers an output Q of "0" upon receiving a reset input R of "1". This output Q of "0" corresponds to a pre-purge termination signal 11 which is relayed to an output circuit for producing an igniter driving signal 7 and a fuel valve driving signal 8. A differential pulse generating circuit 27 is comprised of two delayed-type flip-flop (D flip-flop) circuits 28 and 29 and an AND gate 30, as well known in the art. The circuit 27 generates an impulse of "1" when the output Q of the R-S flip-flop circuit 26 is inverted from "0" to "1". Reference numeral 31 represents an inverter and 32 an AND gate which delivers the ignition-failure signal which is transmitted to an output circuit for producing the safety device driving signal 9.

With this construction, when the operation starting signal 10 is "0", that is, the system is at stop, the reset input Rn to the T flip-flop circuits 13 to 23 is "1" with the output Qn being "0", and the reset input R to the R-S flip-flop circuit 26 is also "1" with the output Q being "0".

Subsequently, a temperature detector operates to produce a temperature signal 5 which makes the operation starting signal 10 "1" so that the reset inputs to the T flip-flop circuits 13 to 23 and the R-S flip-flop circuit 26 are rendered "0", releasing resetting states. Consequently, the T flip-flop circuits 13 to 23 initiate a frequency division operation in accordance with the input of clock pulses 1 such as those produced by half-wave rectification of commercial AC power source, starting to count the pre-purge time. Concurrently with the operation starting signal 10 being rendered "1", a separate circuit (not shown) included in the control circuitry 3 delivers a combustion fan driving signal 6 which actuates a fan for pre-purging the remaining combustion gas.

When the number of clock pulses applied to the flip-flop 13 reaches a value corresponding to the pre-purge time, the output $Q_{23}$ of the T flip-flop circuit 23 is inverted to "1" to which is applied to the R-S flip-flop 26, which in turn delivers a pre-purge time termination signal 11 of "1" at the output Q. This is the first stage operation of the timer circuit for producing the pre-purge time termination signal. The pre-purge is thereby terminated, while the ignition operation begins. More particularly, the pre-purge termination signal 11 of "1" actuates separate circuits (not shown) included in the control circuitry 3 which in turn deliver the fuel valve driving signal 8 and igniter driving signal 7, respectively, thereby initiating combustion. The fan still continues to operate.

On the other hand, the output Q of "1" from the R-S flip-flop circuit 26 also causes the differential pulse generating circuit 27 to deliver an impulse of "1" which resets the T flip-flop circuits 13 to 23 temporarily. This temporary reset state is released by disappearance of the impulse and the T flip-flop circuit again start its frequency division operation effecting on the clock pulses 1. This is the initiation of the second phase timer operation of the timer circuit as a safety timer for counting the safety time.

When ignition has been completed within a predetermined safety time and the flame then produced is detected by a flame detector (not shown), a flame signal of "1" is applied to the terminal 4 and then inverted to "0" by an inverter 31. Thus, an AND gate 32 receiving this input of "0" delivers an output of "0" thereby to maintain the ignition-failure signal terminal 12 at "0", result-produced at the end of counting of the pre-purge time, and in the event that a flame signal is not produced within a predetermined period of time after the occurrence of the pre-purge termination signal, an ignition-failure signal is produced in response to a predetermined time termination signal produced at the end of the predetermined period of time thereby to stop the ignition operation, and wherein a first flip-flop device is provided for determining the end of said predetermined period of time, said first flip-flop device being composed of at least a part of a second flip-flop circuit device provided for effecting frequency division on clock pulses provided by said clock pulse producing source thereby to determine the end of counting of said pre-purge time, further comprising means for holding an output signal which is provided by said second flip-flop device at the end of counting of said pre-purge time, the output of said holding means being used as said pre-purge termination signal and a logical gate for producing said ignition-failure signal under an AND condition of one of said output from said second flip-flop device and said predetermined time termination signal, said pre-purge termination signal and said flame signal.

2. A timer circuit arrangement according to claim 1 wherein said holding means comprises as R-S flip-flop circuit having a reset terminal connected to receive said operation starting signal.

3. A timer circuit arrangement according to claim 1, further comprising circuit means for generating an impulse upon receiving the output delivered by the second flip-flop circuit device or the pre-purge termination signal an output of said means being connected to the reset terminal of said second flip-flop circuit device, and wherein said logical gate is arranged to receive said pre-purge termination signal.

4. A timer circuit arrangement according to claim 3 wherein the flip-flop stage of said first flip-flop circuit device where said predetermined time termination signal is produced is the same as the flip-flop stage of said second flip-flop circuit device where the output signal indicative of the end of counting of said pre-purge time is produced, and said logical gate receives said clock pulse or an output of the flip-flop stage preceding to said first-mentioned flip-flop stage.

5. A timer circuit arrangement according to claim 4 wherein the output of said logical gate is connected to a latch circuit from which said ignition-failure signal is produced.

6. A timer circuit arrangement according to claim 5 wherein said latch circuit comprises an R-S flip-flop circuit.

7. A timer circuit arrangement according to claim 1 wherein the first and second flip-flop circuits are not reset after the pre-purge time has elapsed.

8. A timer circuit arrangement according to claim 7 wherein operation of the first and second flip-flop circuits is stopped by the flame signal.

9. A timer circuit arrangement according to claim 8 which comprises a logical gate preceding the first flip-flop circuit and receiving the flame signal and the clock pulse.

10. A timer circuit arrangement in a digital combustion control system in which the pre-purge operation is started with an operating starting signal and the ignition operation is started with a pre-purge termination signal which is produced at the end of a predetermined pre-purge time interval after occurrence of said operation starting signal, while said ignition operation is stopped with an ignition-failure signal which is produced at the end of a predetermined safety time interval after occurrence of said pre-purge termination signal when a flame signal is not produced within said predetermined safety time interval, said timer circuit arrangement comprising:

pre-purge time counter means coupled to a clock pulse producing source which begins to count clock pulses from said clock pulse producing source with the operation starting signal and produces a first output for determining the end of said predetermined pre-purge time interval, said first output being produced when the count of said counter means reaches a first value corresponding to said predetermined pre-purge time interval;

safety time counter means comprising at least a part of said pre-purge time counter means so that said safety time counter means and said part of said pre-purge counter means are common to one another, said safety time counter means producing a second output which may be used as said safety time termination signal, said second output being produced when the number of the clock pulses counted by said part of said pre-purge time counter means forming said safety time counter means subsequent to the occurrence of said first output reaches a second value predetermined depending on said predetermined safety time interval; and means for producing the ignition-failure signal upon occurrence of said safety time termination signal when the flame signal is not produced within said predetermined safety time interval after the occurrence of said first output.

11. A timer circuit arrangement according to claim 10, wherein said pre-purge time counter means includes first to n-th flip-flop stages connected in series in that order, where n is an integer, for counting the clock pulses applied to said first stage and producing said first output at said n-th stage, and said safety time counter means is arranged by using the series connection of said first to m-th flip-flop stages, where m is an integer and $m \leqq n$, so as to produce said second output at said m-th stage when the number of the clock pulses applied to said first stage reaches said second value.

12. A timer circuit arrangement according to claim 11, wherein said pre-purge time counter means further comprises means for holding said first output, the output of said holding means being used as said pre-purge termination signal and said ignition-failure signal producing means comprises a logical gate for producing said ignition-failure signal under an AND condition of one of said first output and said pre-purge termination signal, said safety time termination signal and said flame signal.

13. A timer circuit arrangement according to claim 12, wherein said m-th flip-flop stage is the same as said n-th flip-flop stage, i.e. $m=n$, and said logical gate receives said clock pulses or an output of the k-th flip-flop stage where $1=k<m$.

14. A timer circuit arrangement according to claim 13, wherein the output of said logical gate is connected to a latch circuit from which said ignition-failure signal is produced.

15. A timer circuit arrangement according to claim 14, wherein said latch circuit comprises an R-S flip-flop circuit.

ing in preventing delivery of the safety device driving signal 9.

In the event of failure of ignition, at the termination of counting of the clock pulses corresponding to the predetermined safety time by the safety time, the output $Q_{21}$ of the T flip-flop circuit 21 becomes "1" while the flame signal 4 being "0" and accordingly, all the inputs of the AND gate 32 are "1" thereby to produce an output of "1" which is the ignition-failure signal 12, which causes the control circuit to produce the safety device driving signal 9 for stopping all the operations together with generation of an alarm.

If any of the T flip-flop circuits 13 to 23 gets out of order with a result of failure of frequency division operation, the inversion of the output $Q_{23}$ into "1" is prevented. Therefore, the output Q of the R-S flip-flop 26 remains "0" after the lapse of the predetermined pre-purge time so that the progression of the ignition control sequence is prevented so as to prevent the fuel valve from being opened while continuing the drive of the combustion fan, thus ensuring the safety of the system.

As described above, the timer of this invention serves as the pre-purge timer and the safety timer as well such that the operation as the safety timer follows the operation as the pre-purge timer. Therefore, the frequency division operation for determining the pre-purge time serves as the pre-check of the safety timer in advance of its operation. Accordingly, it is possible to improve safety of operation and to minimize the number of T flip-flop circuit.

Strictly, however, if any of the T flip-flop circuits 13 to 21 becomes out of order after operating as the pre-purge timer, the safety of operation cannot be ensured.

It is to be understood that the R-S flip-flop circuit 26 used for holding the pre-purge termination signal in the foregoing embodiment may be omitted provided that the flip-flop circuit 23 is prevented from further operation when the output $Q_{23}$ corresponding to the pre-purge termination signal is delivered. For example, this modification can be achieved by applying an inverted signal of the output $Q_{23}$ via an AND gate to the flip-flop circuits succeeding to the flip-flop circuit 21 that delivers the safety time termination signal. If it is also desired to hold the safety time termination signal, provisions may be made to include a NAND gate for receiving the outputs $Q_{23}$ and $Q_{21}$, such that the output of the NAND gate is fed to an AND gate connected to the clock pulse input terminal of the timer.

Figure 4:
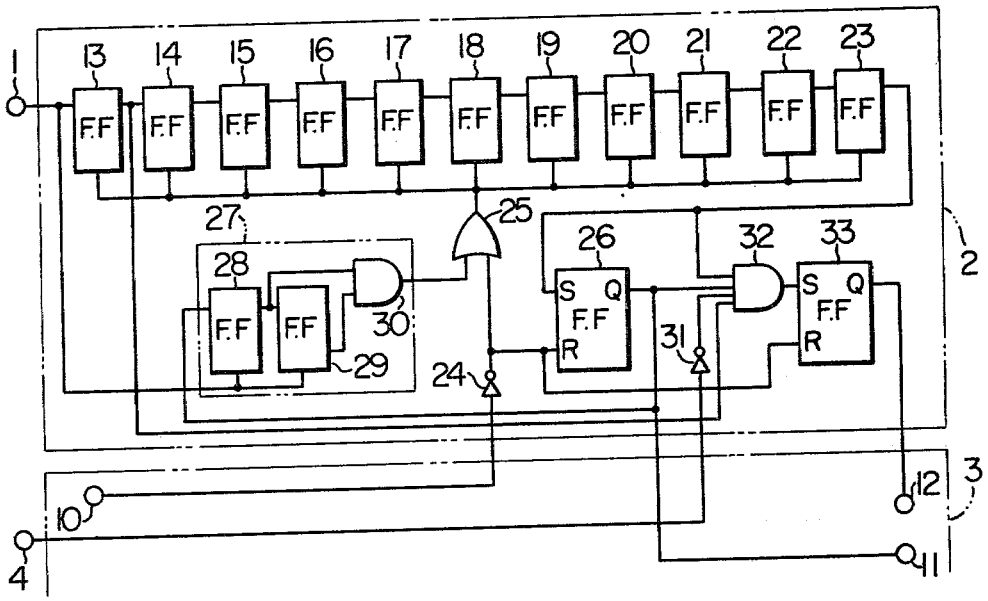
FIGS. 4, 5 and 6 are circuit diagrams of other embodiments of the timer circuit of the invention.

Referring to FIG. 4, another embodiment of this invention is shown wherein the pre-purge time and the safety time are the same. In this embodiment, since the T flip-flop circuits 13 to 23 are reset for restarting the frequency division operation in response to the output of the differential pulse generating circuit 27, it is possible to make substantially equal the safety time and the pre-purge time. Strictly, however, the safety time is longer than the pre-purge time by a short period of time which is negligible.

Since the output $Q_{23}$ is used to produce the pre-purge termination signal and also to produce the ignition failure signal, it is required to prevent the ignition failure signal from being produced when the output $Q_{23}$ goes "1" at the termination of the pre-purge. To this end, the output $Q_{13}$, which is at "0" when the output $Q_{23}$ goes "1", is applied to one of the inputs of the AND gate 32. It will be readily understood for those skilled in the art that any signal which is changeable between "1" and "0" and at "0" when the output $Q_{23}$ goes "1" may be replaced for the output $Q_{13}$.

An additional latch circuit, for example, in the form of an R-S flip-flop 33, is provided and its output Q is used as the ignition-failure signal 12.

The differential pulse generating circuit may be composed of an AND gate having one input connected in series with an odd number of inverters and the other input, along with the series connection of the inverters, connected to the output of the R-S flip-flop circuit 26.

Figure 5:
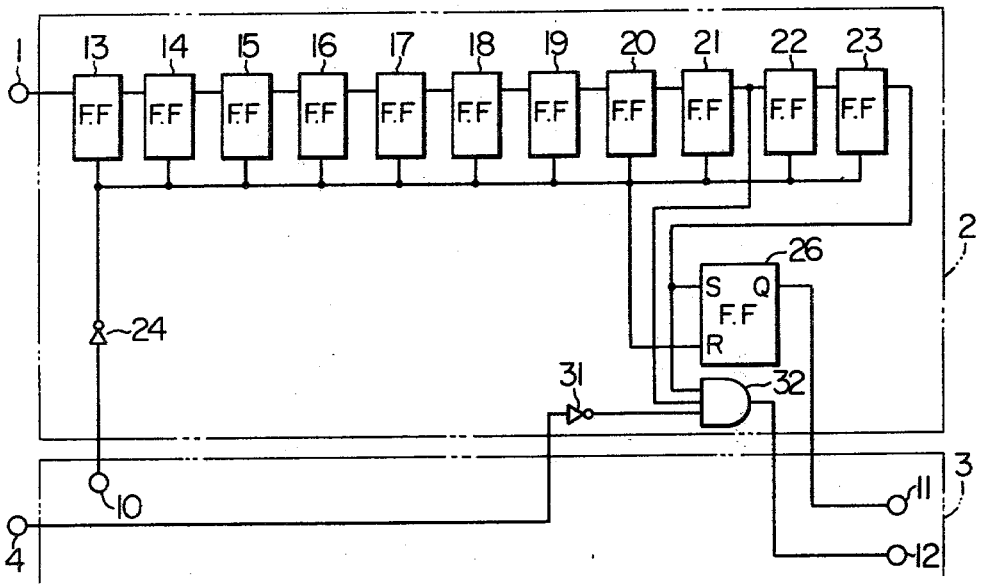

Referring to FIG. 5, still another embodiment is shown wherein the safety time is made shorter than the pre-purge time as using a simplified circuit arrangement. In contrast to the embodiment of FIG. 3 wherein the timer circuits starts its counting operation for the safety time after clearing its previous counts for the pre-purge time, the embodiment of FIG. 5 does not follow this sequence by omitting the differential pulse generating circuit 27.

In FIG. 5, the output of the R-S flip-flop circuit 26 may be fed to the AND gate 32, in place of the output $Q_{23}$.

Figure 6:
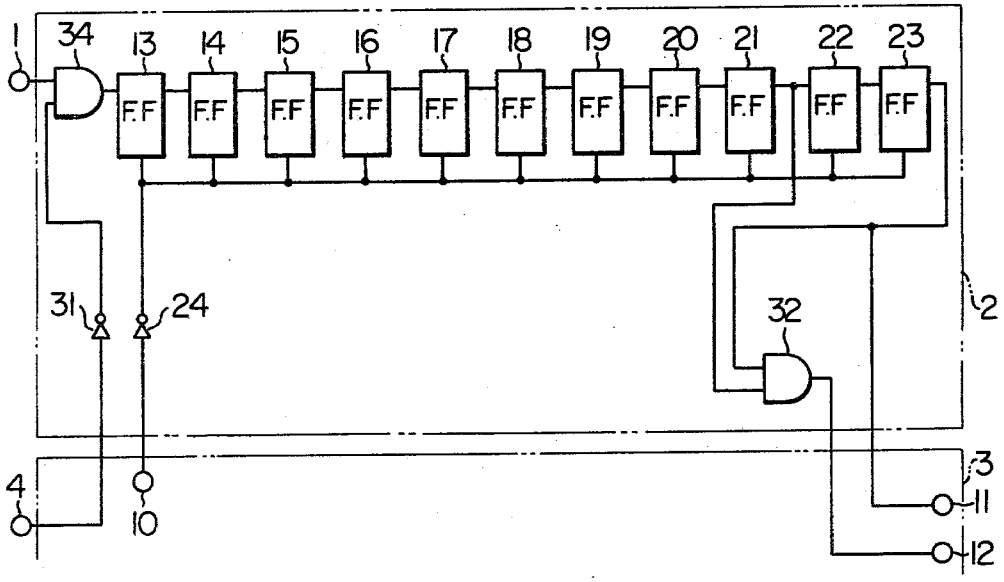

Further, in FIG. 5 the presence or absence of flame signal 4 is checked with the generation of the safety time termination signal $Q_{21}$. However, the timer may be restrained from further operation thereby preventing the delivery of the safety time signal when the flame is present. Such an embodiment is shown in FIG. 6, in which an additional AND gate 34 is provided while the R-S flip-flop circuit is omitted.

The pre-purge time and the safety time vary dependent on the kind of fuel to be used and the size of burner. There are various different combinations of them, for example a combination of 16-second pre-purge time and 16-second safety time and another combination of 16-second pre-purge time and 4-second safety time. Such various different sequences may be achieved by a timer circuit composed of a single integrated circuit element including a series connection of flip-flop whose output stages are selected by command signals delivered from a decoder in accordance with a selected one of the sequences.

In the foregoing embodiments, the safety timer is checked in advance of starting of its operation. However, there still exists a possibility of failure to stop the operation in the event that the AND gate 32 becomes out of order. A solution of this problem may include provision of an additional safety timer which is also used for producing a signal for closing the fuel valve at a predetermined timing in the event of failure of ignition thereby to cease the combination. In this case, the first safety timer provided for actuating the safety device may be a separate one from the pre-purge timer whereas the additional safety timer used for closing the fuel valve may be incorporated into the pre-purge timer. Setting time of the latter safety timer exclusively used for closing the fuel valve may be shorter than the pre-purge time but longer than the safety time for actuating the safety device. Further, it is possible to incorporate the above-mentioned three timers integrally into a single component.

What is claimed is:

1. A timer circuit arrangement in a digital combustion control system coupled to a clock pulse producing source, wherein counting of a pre-purge time is initiated with an operation starting signal with which the pre-purge operation is started and ignition operation is started with a pre-purge termination signal which is 16. A timer circuit arrangement according to claim 11, wherein the first to n-th flip-flop stages are not reset after the pre-purge time has elapsed.

17. A timer circuit arrangement according to claim 16, wherein operation of the first to n-th flip-flop stages is stopped by the flame signal.

18. A timer circuit arrangement according to claim 17, further comprising a logical gate preceding the first flip-flop stage and receiving the flame signal and the clock pulses.

19. A timer circuit arrangement according to claim 10, wherein said pre-purge time counter means further comprises means for holding said first output, the output of said holding means being used as said pre-purge termination signal and said ignition-failure signal producing means comprises a logical gate for producing said ignition-failure signal under an AND condition of one of said first output and said pre-purge termination signal, said safety time termination signal and said flame signal.

20. A timer circuit arrangement according to claim 19, wherein said holding means comprises an R-S flip-flop circuit having a reset terminal connected to receive said operation starting signal.

21. A timer circuit arrangement according to claim 19, wherein said pre-purge time counter means further comprises a reset terminal and circuit means for generating an output pulse upon receiving said first output or said pre-purge termination signal, said output pulse being connected to said reset terminal, and wherein said logical gate is arranged to receive said pre-purge termination signal.

22. A timer circuit arrangement according to claim 10, wherein said operation of said part of said pre-purge time counter means which comprises said safety time counter means during the pre-purge time interval serves as a pre-check for the operation of the safety time counter means in advance of its operation during the safety time interval so that if said part of said pre-purge time counter means which comprises said safety time checker is faulty during said pre-purge time interval said ignition operation will not be begun.

* * * * *